US007589680B2

(12) United States Patent
Tsai et al.

(10) Patent No.: US 7,589,680 B2
(45) Date of Patent: Sep. 15, 2009

(54) ANTENNA UNIT WITH A PARASITIC COUPLER

(75) Inventors: Tiao-Hsing Tsai, Tao Yuan Shien (TW); Chieh-Ping Chiu, Tao Yuan Shien (TW); Chih-Wei Liao, Tao Yuan Shien (TW)

(73) Assignee: Quanta Computer Inc., Tao Yuan Shien (TW)

( * ) Notice: Subject to any disclaimer, the term of this patent is extended or adjusted under 35 U.S.C. 154(b) by 149 days.

(21) Appl. No.: 11/841,097

(22) Filed: Aug. 20, 2007

(65) Prior Publication Data

US 2008/0258992 A1 Oct. 23, 2008

(30) Foreign Application Priority Data

Apr. 17, 2007 (TW) ..... 96113455 A

(51) Int. Cl.
*H01Q 1/24* (2006.01)

(52) U.S. Cl. ..... 343/702; 343/700 MS

(58) Field of Classification Search ..... 343/700 MS, 343/702, 853
See application file for complete search history.

(56) References Cited

U.S. PATENT DOCUMENTS

| | | | | |
|---|---|---|---|---|
| 2,821,711 | A * | 1/1958 | Lo | 343/819 |
| 2,987,723 | A * | 6/1961 | Guernsey | 343/813 |
| 6,016,126 | A * | 1/2000 | Holshouser | 343/702 |
| 6,326,921 | B1 * | 12/2001 | Egorov et al. | 343/700 MS |
| 2002/0019247 | A1 * | 2/2002 | Egorov | 455/557 |

* cited by examiner

*Primary Examiner*—Tho G Phan
(74) *Attorney, Agent, or Firm*—Ladas & Parry LLP

(57) ABSTRACT

An antenna unit includes left and right antennas that are spaced apart from each other and that are operable within a first frequency bandwidth, and a parasitic coupler that is spaced apart from and disposed between the left and right antennas, and that is electromagnetically coupled to the left and right antennas so as to be operable within a second frequency bandwidth.

14 Claims, 15 Drawing Sheets

Peak = 1.02 dBi, Avg. = -1.78 dBi.

Peak = 3.1 dBi, Avg. = 0.07 dBi.

Peak = 2.86 dBi, Avg. = -1.23 dBi.

Peak = 4.06 dBi, Avg. = -1.22 dBi

Peak = 3.5 dBi, Avg. = -0.23 dBi

Peak = -0.71 dBi, Avg. = -4.77 dBi.

Peak = 2.89 dBi, Avg. = -0.61 dBi.

Peak = -0.31 dBi, Avg. = -4.84 dBi.

Peak = 2.26 dBi, Avg. = -2.1 dBi.

ANTENNA UNIT WITH A PARASITIC COUPLER

CROSS-REFERENCE TO RELATED APPLICATION

This application claims priority of Taiwanese application no. 096113455, filed on Apr. 17, 2007.

BACKGROUND OF THE INVENTION

1. Field of the Invention

This invention relates to an antenna unit, more particularly to an antenna unit with a parasitic coupler.

2. Description of the Related Art

FIG. 1 illustrates a conventional dual-band antenna unit mounted in a notebook computer 1. The notebook computer 1 includes a lower housing 12, a keyboard 16 mounted on the lower housing 12, an upper housing 11 coupled pivotably to the lower housing 12, a liquid crystal display (LCD) 17 mounted on the upper housing 11, a grounding plate 18 mounted in the upper housing 11, an image-capturing device 19 mounted on the upper housing 11 and disposed above the grounding plate 18 between upper left and right corners of the upper housing 11, and a securing member 15 that secures the grounding plate 18 and the image-capturing device 19 on the upper housing 11. The conventional antenna unit includes left and right antennas 14, 13, each of which is a planar inverted-F antenna (PIFA) and is connected to the grounding plate 18 via the securing member 15. The left antenna 14 is operable within the 2.4 GHz bandwidth and is disposed adjacent to the upper left corner of the upper housing 11, whereas the right antenna 13 is operable within the 5.0 GHz bandwidth and is disposed adjacent to the upper right corner of the upper housing 11.

The aforementioned conventional antenna unit is disadvantageous in that the left and right antennas 14, 13 have a relatively large physical size. Moreover, the securing member 15 undesirably affects transmission and reception of signals by the left and right antennas 14, 13, and thereby decreasing efficiencies of the left and right antennas 14, 13.

To solve the above problem, as illustrated in FIG. 2, it has been proposed to place both the left and right antennas 14, 13 in close proximity, remove the securing member 15, and connect the left and right antennas 14, 13 directly to the grounding plate 18. This configuration, however, can cause other problems. Particularly, interference is generated between the signals associated with the left and right antennas 14, 13. Moreover, since this conventional antenna unit is not secured on the upper housing 11, the left and right antennas 14, 13 are easily deformed during assembly.

SUMMARY OF THE INVENTION

Therefore, the object of the present invention is to provide an antenna unit that can overcome the aforesaid drawbacks of the prior art.

According to the present invention, an antenna unit comprises left and right antennas that are spaced apart from each other and that are operable within a first frequency bandwidth, and a parasitic coupler that is spaced apart from and disposed between the left and right antennas, and that is electromagnetically coupled to the left and right antennas so as to be operable within a second frequency bandwidth different from the first frequency bandwidth.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
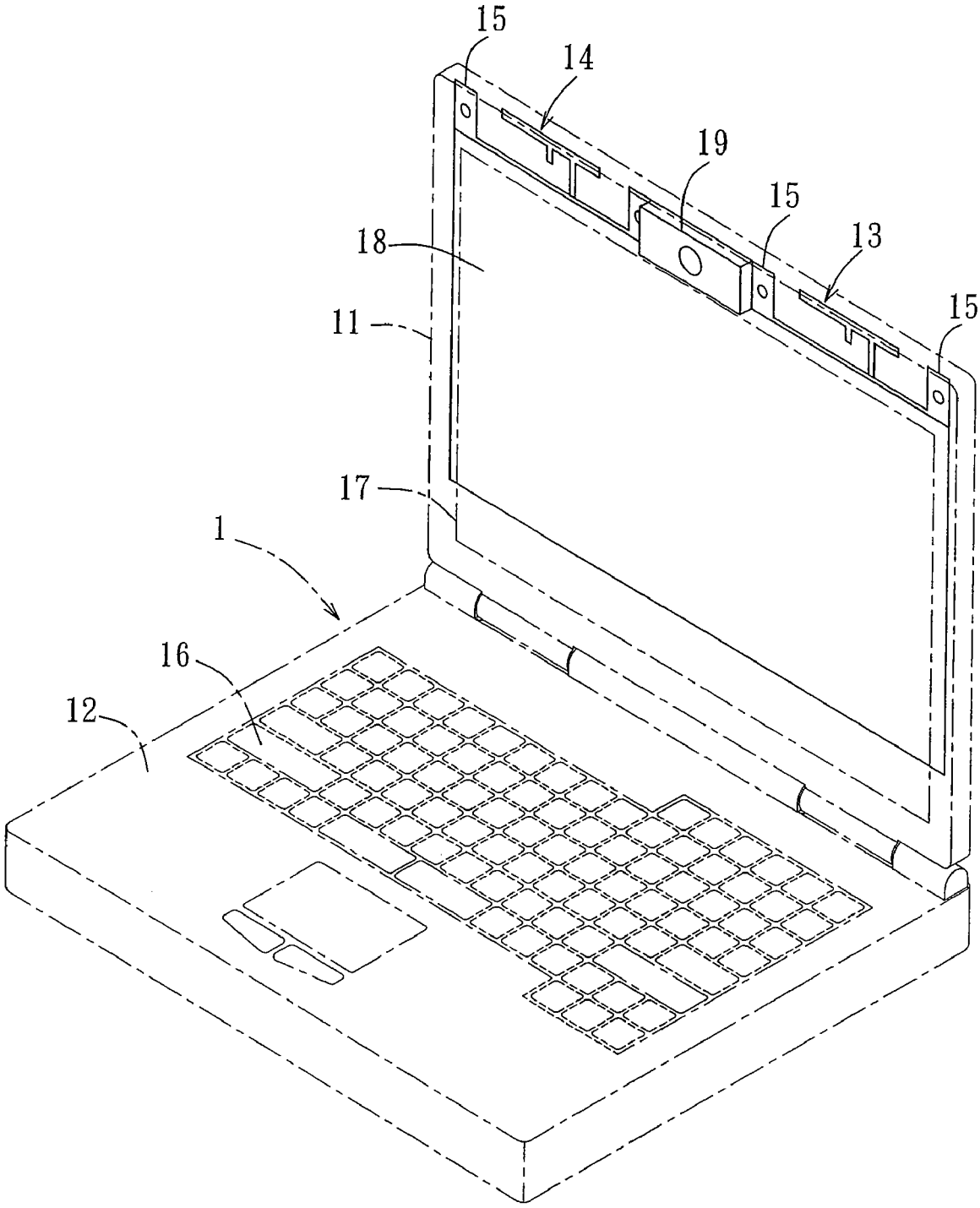
FIG. 1 PRIOR ART
FIG. 1 is a schematic view of a conventional antenna unit.
Figure 2:
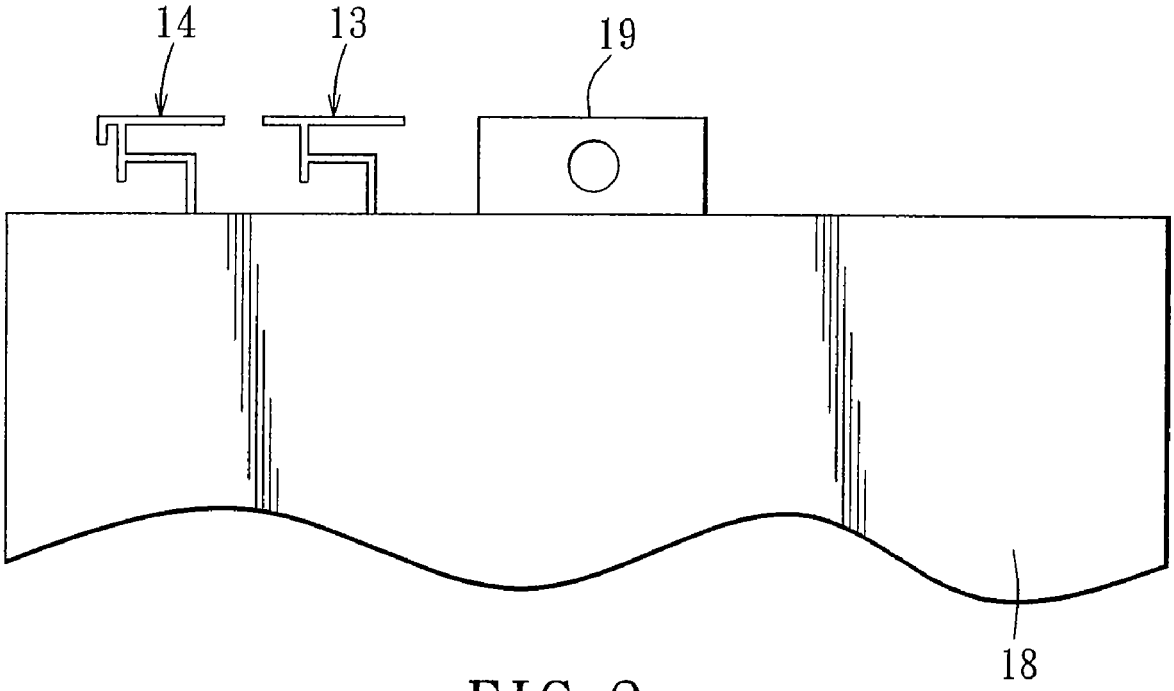
FIG. 2 PRIOR ART
FIG. 2 is a schematic view of another conventional antenna unit.

Before the present invention is described in greater detail, it should be noted that like elements are denoted by the same reference numerals throughout the disclosure.

Figure 3:
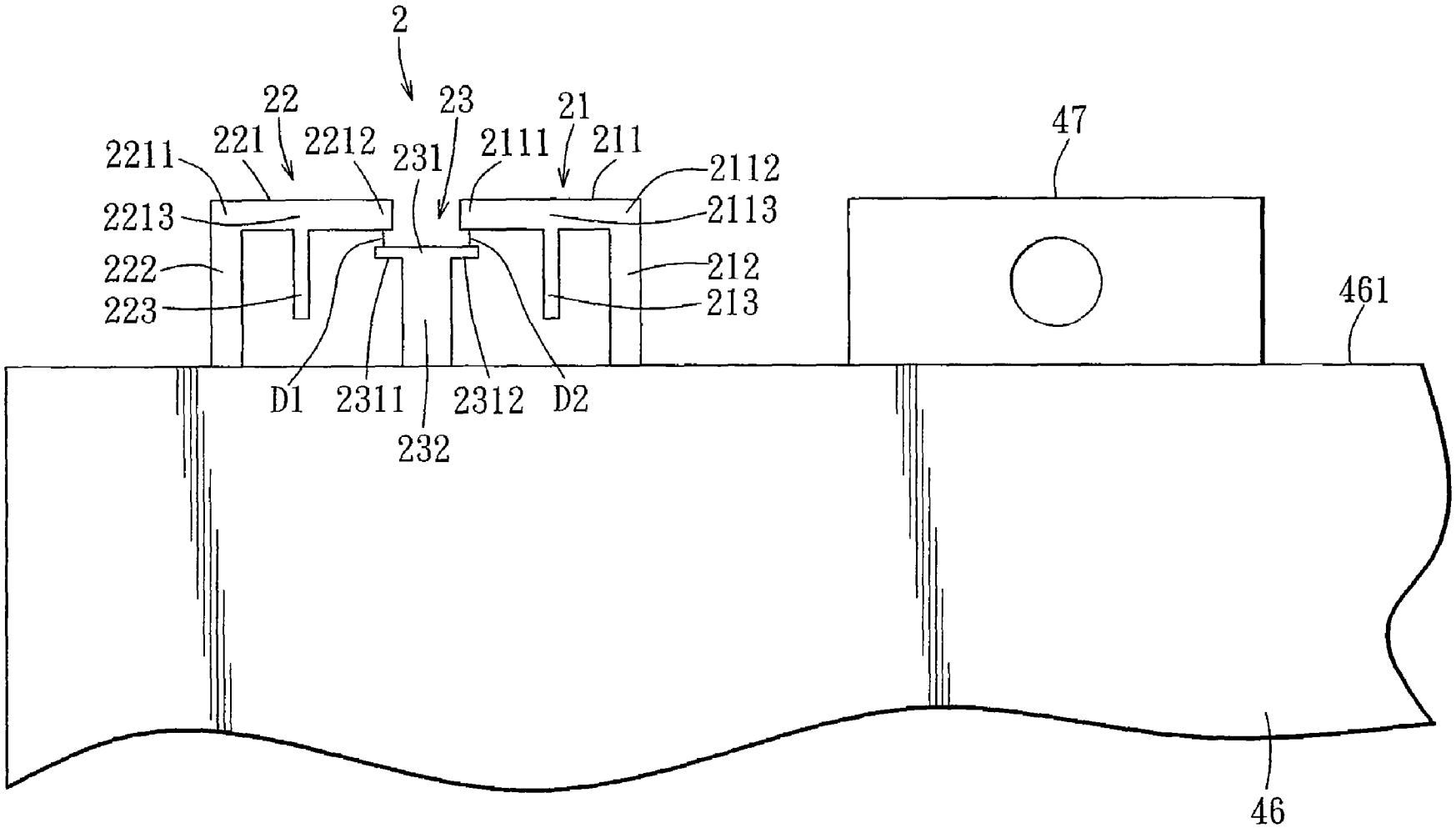
FIG. 3 is a schematic view of the first preferred embodiment of an antenna unit according to this invention.

Referring to FIG. 3, the first preferred embodiment of an antenna unit 2 according to this invention is shown to include left and right antennas 22, 21 and a parasitic coupler 23.

The antenna unit 2 of this embodiment is a dual-band antenna unit that is suitable for wireless networking applications, such as a wireless local area network (WLAN) or a wireless wide area network (WWAN), and that is operable within a first frequency bandwidth, and within a second frequency bandwidth different from the first frequency bandwidth. In this embodiment, the first frequency bandwidth is the 2.4 GHz bandwidth, and the second frequency bandwidth is the 5.0 GHz bandwidth. In an alternative embodiment, the first frequency bandwidth is the 5.0 GHz bandwidth, and the second frequency bandwidth is the 2.4 GHz bandwidth.

Figure 4:
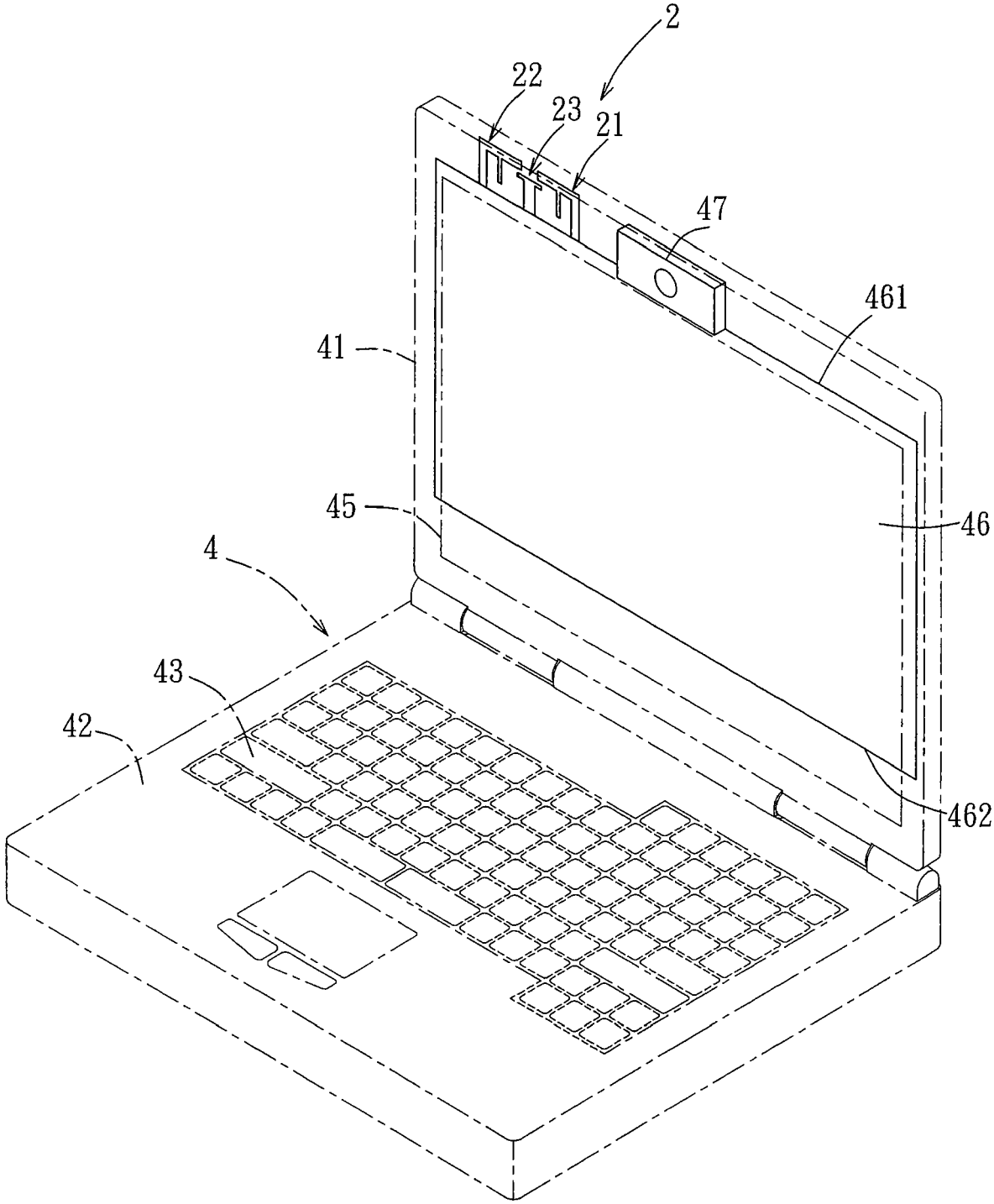
FIG. 4 is a schematic view illustrating the first preferred embodiment mounted in an electronic device.

With further reference to FIG. 4, the antenna unit 2 is mounted in an electronic device 4, such as a notebook computer. In this embodiment, the electronic device 4 includes a lower housing 42, a keyboard 43 mounted on the lower housing 42, an upper housing 41 coupled pivotably to the lower housing 42, a liquid crystal display (LCD) 45 mounted on the upper housing 41, a grounding plate 46 that is mounted in the upper housing 41 and that has upper and lower edges 461, 462, an image-capturing device 47 mounted on the upper housing 41 and disposed above the grounding plate 46 between upper left and right corners of the upper housing 41, and first and second signal sources (not shown) mounted in the upper housing 41.

The antenna unit 2 is disposed between the upper left corner of the upper housing 41 and the image-capturing device 47.

The left antenna 22 is operable within the first frequency bandwidth, i.e., the 2.4 GHz bandwidth, is a planar inverted-F antenna (PIFA), and includes a radiating element 221, a grounding element 222, and a feeding element 223. The radiating element 221 of the left antenna 22 has left and right ends 2211, 2212, and an intermediate portion 2213 that interconnects the left and right ends 2211, 2212 thereof. The grounding element 222 of the left antenna 22 has an upper end connected to the left end 2211 of the radiating element 221 of the left antenna 22, and a lower end connected to an upper edge 461 of the grounding plate 46. The feeding element 223 of the left antenna 22 has an upper end connected to the intermediate portion 2213 of the radiating element 221 of the left antenna 22, and a lower end connected to the first signal source.

The right antenna 21 is spaced apart from the left antenna 22, is operable within the first frequency bandwidth, i.e., the 2.4 GHz bandwidth, is a PIFA, and includes a radiating element 211, a grounding element 212, and a feeding element 213. The radiating element 211 of the right antenna 21 has left and right ends 2111, 2112, and an intermediate portion 2113 that interconnects the left and right ends 2111, 2112 thereof. The grounding element 212 of the right antenna 21 has an upper end connected to the right end 2112 of the radiating element 211 of the right antenna 21, and a lower end connected to the upper edge 461 of the grounding plate 46. The feeding element 213 of the right antenna 21 has an upper end connected to the intermediate portion 2113 of the radiating element 211 of the right antenna 21, and a lower end connected to the second signal source.

The parasitic coupler 23 is spaced apart from and disposed between the left and right antennas 22, 21, and is electromagnetically coupled to the radiating elements 221, 211 of the left and right antennas 22, 21 so as to be operable within the second frequency bandwidth, i.e., the 5.0 Ghz bandwidth. In particular, the parasitic coupler 23 is generally T-shaped, and includes a coupling element 231 and a grounding element 232. The coupling element 231 of the parasitic coupler 23 has left and right ends 2311, 2312, and an intermediate portion that interconnects the left and right ends 2311, 2312 thereof. The grounding element 232 of the parasitic coupler 23 has an upper end connected to the intermediate portion of the coupling element 231 of the parasitic coupler 23, and a lower end connected to the upper edge 461 of the grounding plate 46. The right end 2212 of the radiating element 221 of the left antenna 22 is disposed proximate to and above the left end 2311 of the coupling element 231 of the parasitic coupler 23, and the left end 2111 of the radiating element 211 of the right antenna 21 is disposed proximate to and above the right end 2312 of the coupling element 231 of the parasitic coupler 23. In this embodiment, the right end 2212 of the radiating element 221 of the left antenna 22 and the left end 2311 of the coupling element 231 of the parasitic coupler 23 define a first vertical distance (D1) therebetween that ranges from 0.5 millimeters to 3.0 millimeters, and the left end 2111 of the radiating element 211 of the right antenna 21 and the right end 2312 of the coupling element 231 of the parasitic coupler 23 define a second vertical distance (D2) therebetween that ranges from 0.5 millimeters to 3.0 millimeters.

It is noted herein that since the left and right antennas 22, 21 are operable within the first frequency bandwidth, and since the parasitic coupler 23 is disposed between the left and right antennas 22, 21, and is electromagnetically coupled to the radiating elements 221, 211 of the left and right antennas 22, 21 so as to be operable within the second frequency bandwidth, the antenna unit 2 of this invention has a relatively small physical size.

It is further noted herein that the electromagnetic coupling between the parasitic coupler 23 and the radiating elements 221, 211 of the left and right antennas 22, 21 may be increased or decreased, for the purpose of impedance matching, by simply adjusting the first and second vertical distances (D1, D2).

Figure 5:
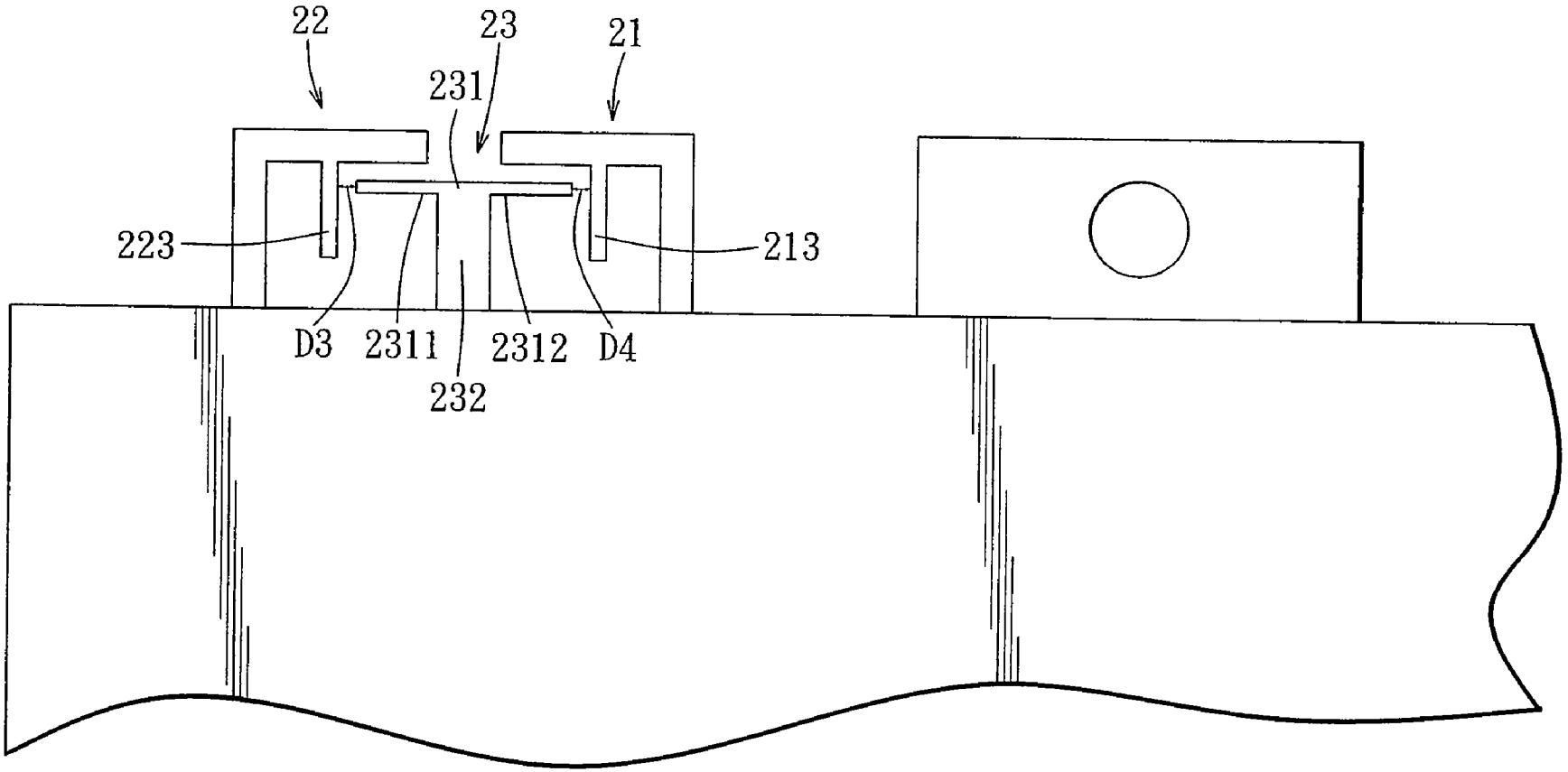
FIGS. 5 and 6 are schematic views illustrating modified embodiments of the first preferred embodiment according to this invention.

FIG. 5 is a modified embodiment of the first preferred embodiment according to this invention. In this embodiment, the parasitic coupler 23 is electromagnetically coupled to the feeding elements 223, 213 of the left and right antennas 22, 21 so as to be operable within the second frequency bandwidth. That is, the left end 2311 of the coupling element 231 of the parasitic coupler 23 is disposed proximate to the feeding element 223 of the left antenna 22 such that the left end 2311 of the coupling element 231 of the parasitic coupler 23 and the feeding element 223 of the left antenna 22 define a first horizontal distance (D3) therebetween that ranges from 0.5 millimeters to 3.0 millimeters. Moreover, the right end 2312 of the coupling element 231 of the parasitic coupler 23 is disposed proximate to the feeding element 213 of the right antenna 21 such that the right end 2312 of the coupling element 231 of the parasitic coupler 23 and the feeding element 213 of the right antenna 21 define a second horizontal distance (D4) therebetween that ranges from 0.5 millimeters to 3.0 millimeters.

Figure 6:
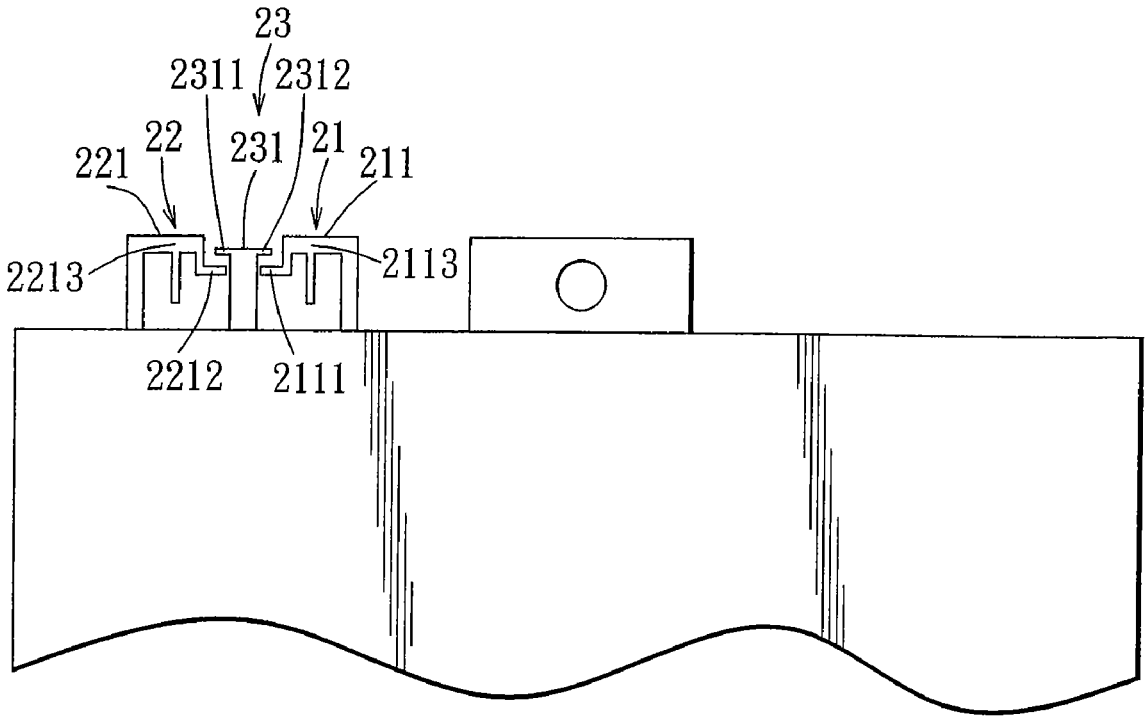

FIG. 6 illustrates another modified embodiment of the first preferred embodiment according to this invention. In this embodiment, the intermediate portion 2213, 2113 of the radiating element 221, 211 of each of the left and right antennas 22, 21 is generally L-shaped. Moreover, the right end 2212 of the radiating element 221 of the left antenna 22 is disposed below the left end 2311 of the coupling element 231 of the parasitic coupler 23, and the left end 2111 of the radiating element 211 of the right antenna 21 is disposed below the right end 2312 of the coupling element 231 of the parasitic coupler 23.

Figure 7:
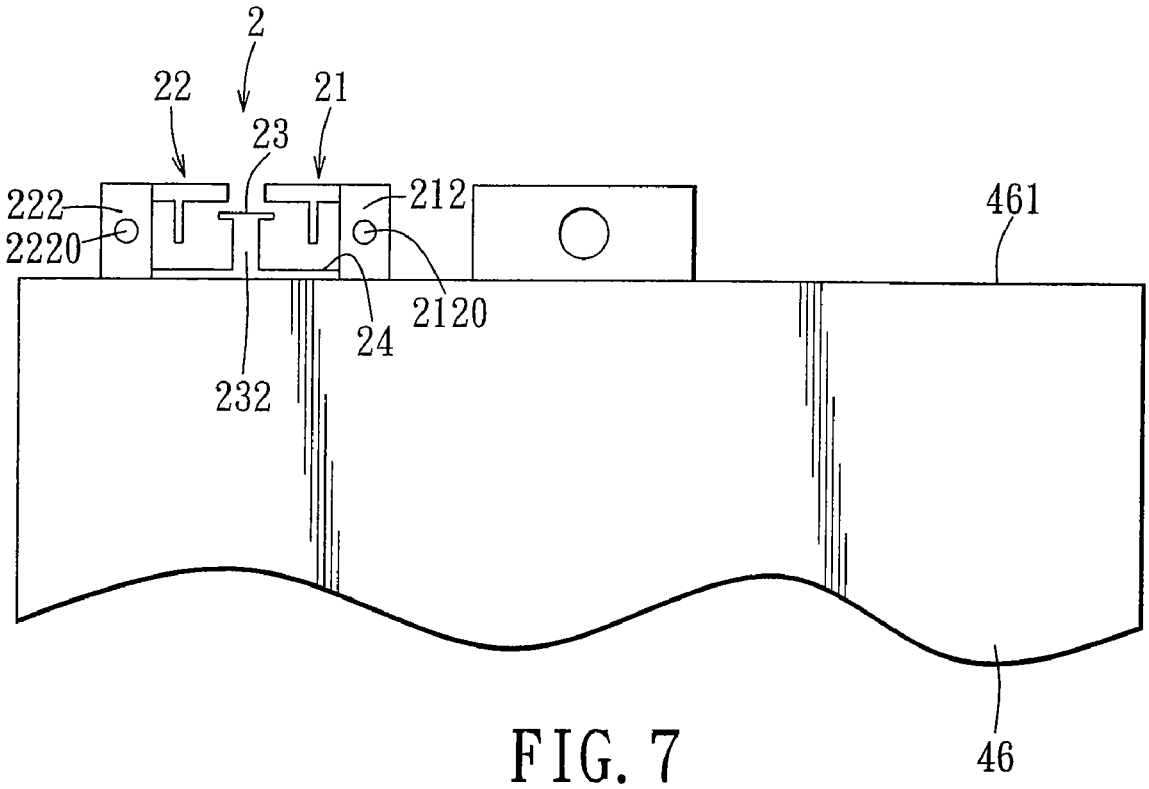
FIG. 7 is a schematic view of the second preferred embodiment of an antenna unit according to this invention.
Figure 8:
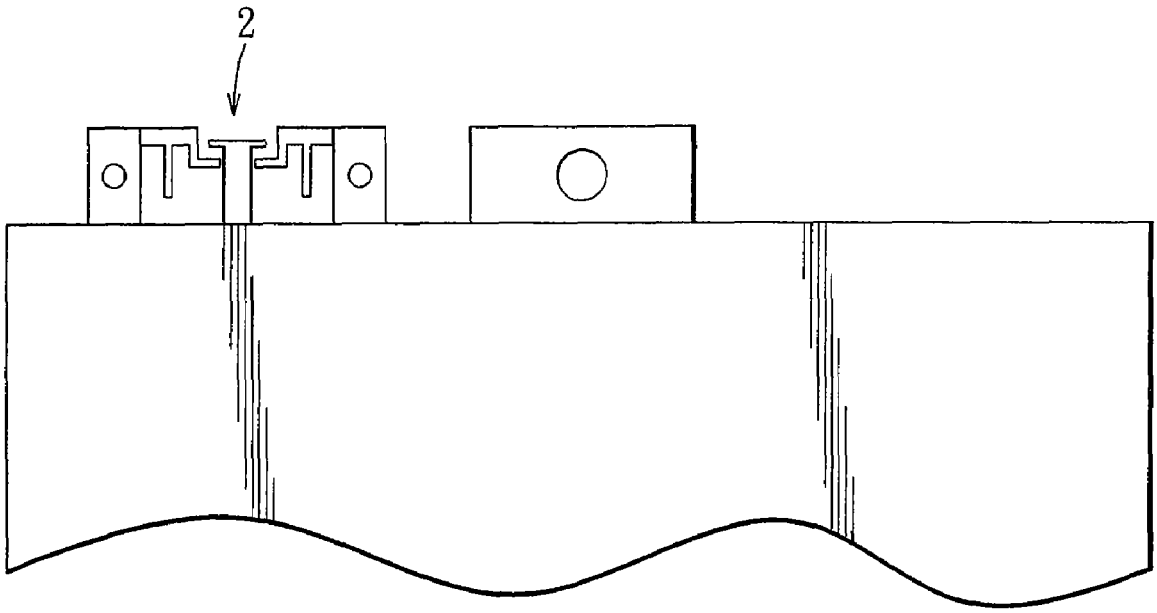
FIGS. 8 to 15 are schematic views illustrating modified embodiments of the second preferred embodiment according to this invention.
Figure 9:
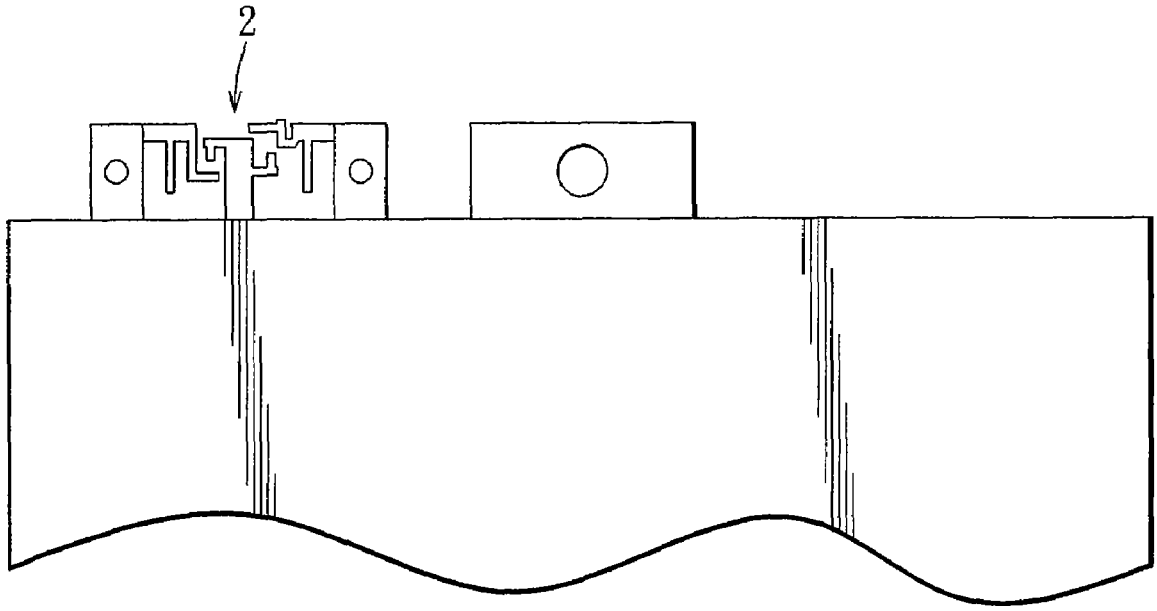
Figure 10:
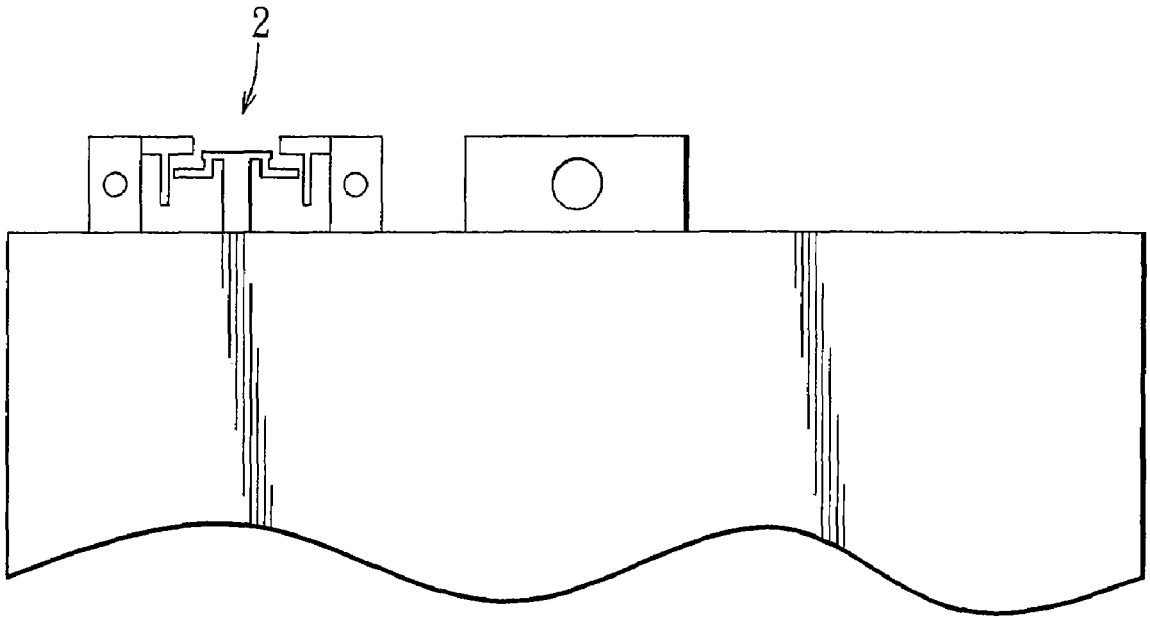
Figure 11:
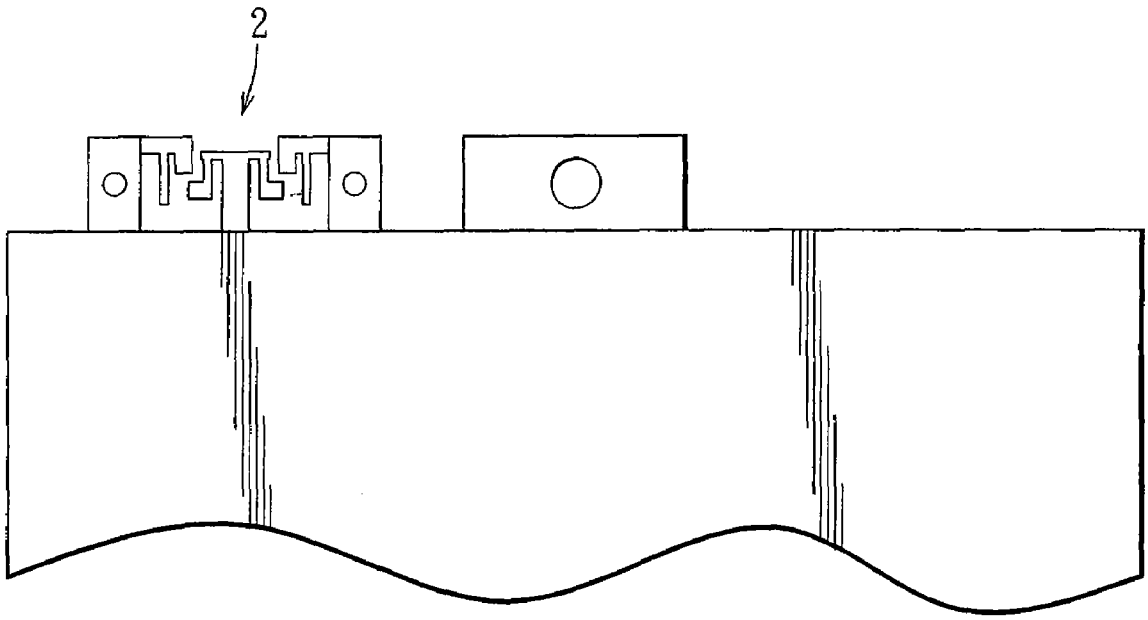
Figure 12:
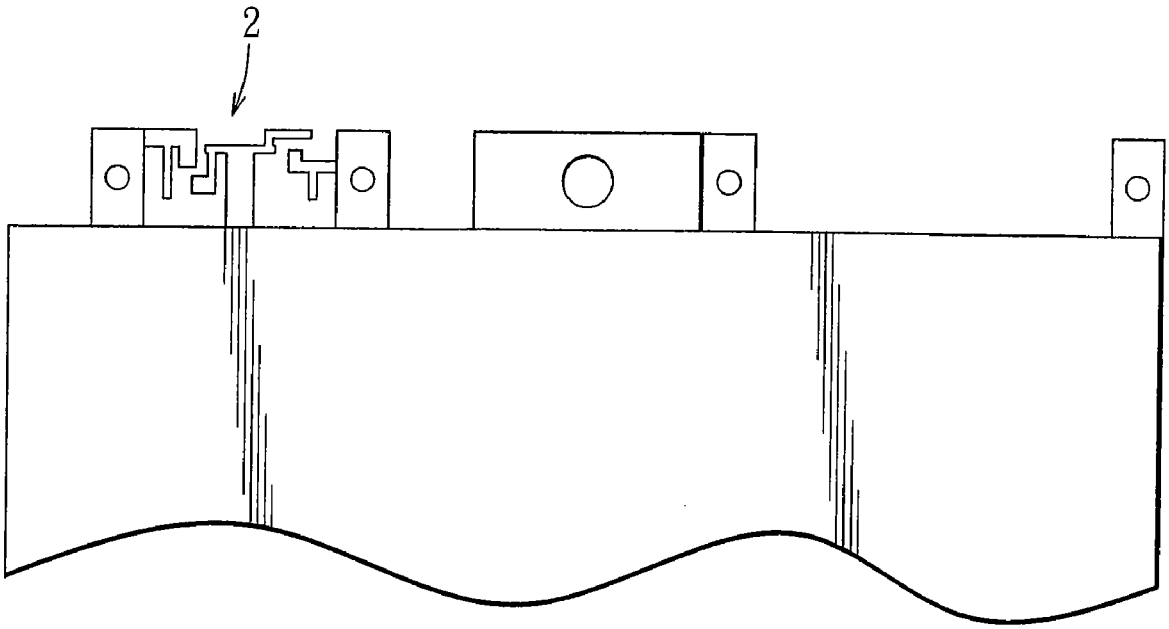
Figure 13:
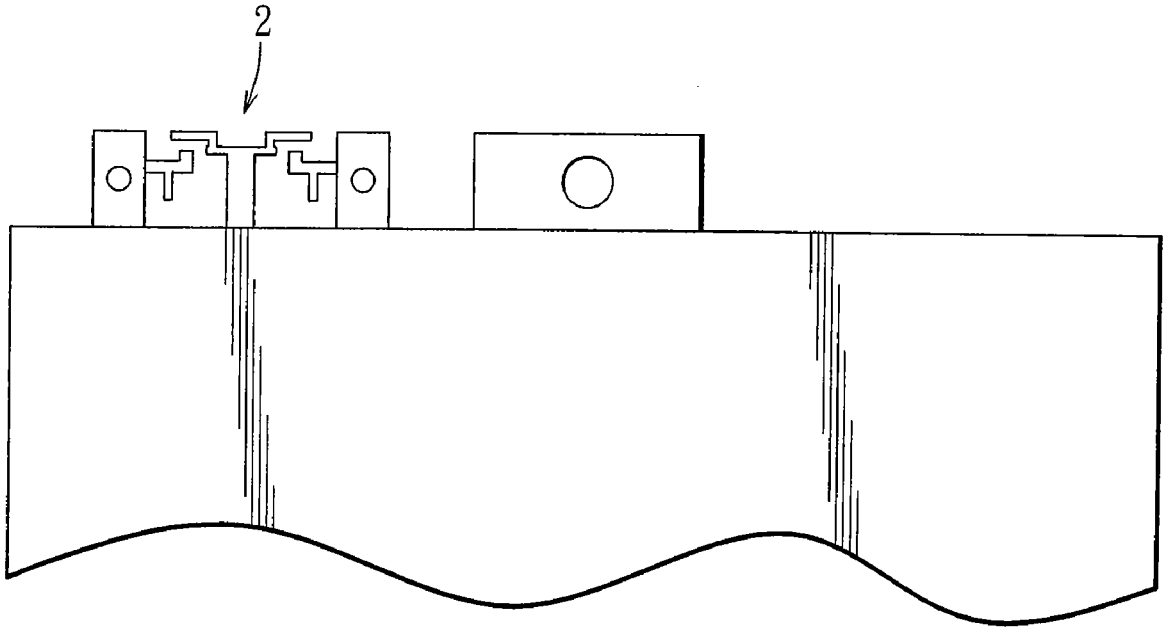
Figure 14:
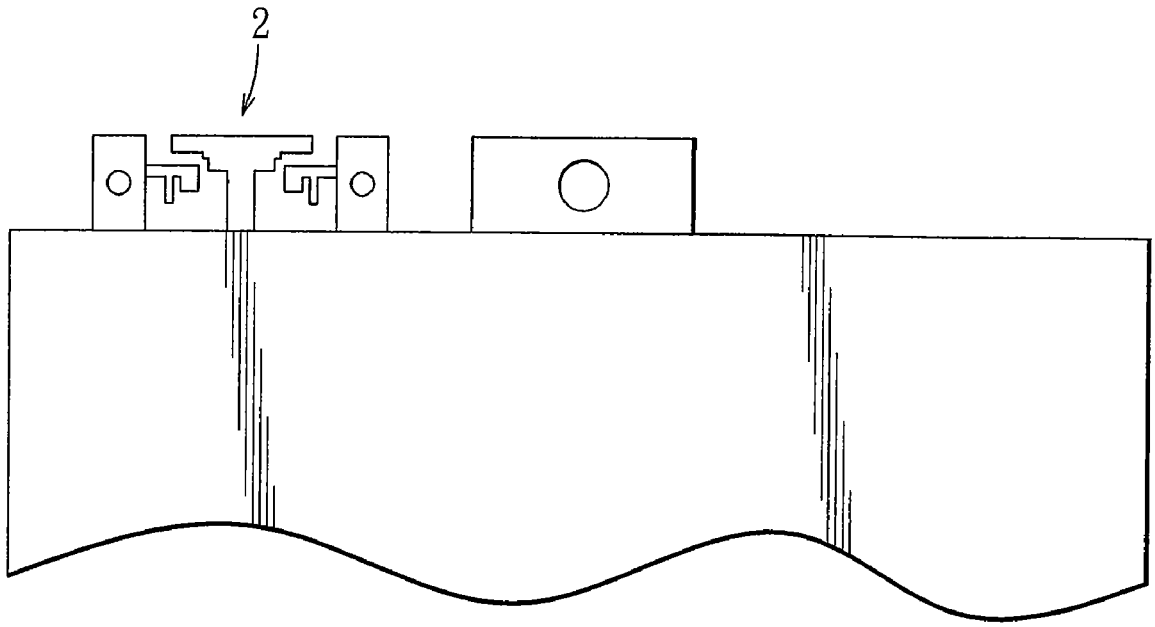
Figure 15:
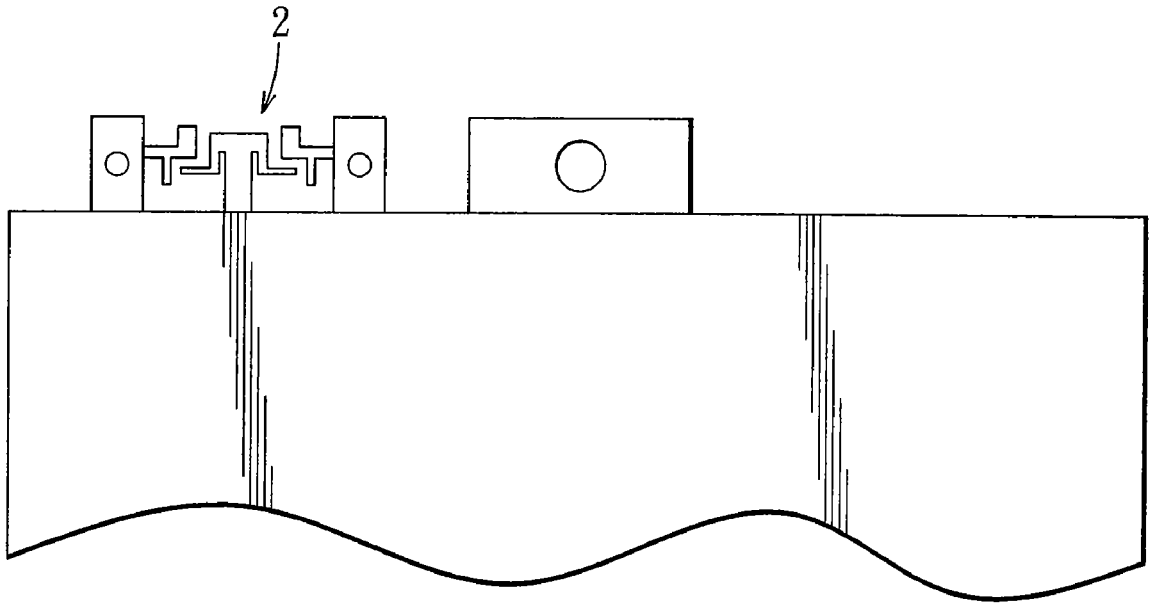

FIG. 7 illustrates the second preferred embodiment of an antenna unit 2 according to this invention. When compared to the first preferred embodiment, the antenna unit 2 of this embodiment further includes a metallic strip 24 that interconnects the lower ends of the grounding elements 222, 212 of the left and right antennas 22, 21, the lower end of the grounding element 232 of the parasitic coupler 23, and the upper edge 461 of the grounding plate 46. Moreover, the left and right antennas 22, 21 are secured to the upper housing 41 (see FIG. 4) with the use of a pair of screws (not shown). In particular, the grounding element 222, 212 of each of the left and right antennas 22, 21 is formed with a hole 2220, 2120 therethrough. Each of the screws extends through the hole 2220, 2120 in the grounding element 222, 212 of a respective one of the left and right antennas 22, 21 and is fastened to the upper housing 41.

FIGS. 8 to 15 are modified embodiments of the second preferred embodiment according to this invention.

TABLE I

| | Frequency (GHz) | Total Radiation Power (dB) | Radiation Efficiency (%) |
|---|---|---|---|
| Radiating element 221 of left antenna 22 and parasitic coupler 23 | 2.412 | −1.8 | 66.1 |
| | 2.437 | −1.6 | 69.3 |
| | 2.462 | −1.4 | 72.9 |
| | 5.150 | −2.7 | 53.7 |
| | 5.350 | −1.5 | 71.4 |
| | 5.470 | −1.8 | 65.6 |
| | 5.725 | −1.3 | 74.4 |
| | 5.785 | −2.0 | 62.9 |
| Radiating element 212 of right antenna 21 and parasitic coupler 23 | 2.412 | −2.0 | 63.1 |
| | 2.437 | −1.6 | 69.1 |
| | 2.462 | −1.4 | 73.2 |
| | 5.150 | −2.3 | 59.1 |
| | 5.350 | −1.1 | 78.4 |
| | 5.470 | −1.4 | 71.7 |
| | 5.725 | −1.7 | 67.5 |
| | 5.785 | −2.3 | 59.4 |

Figure 16:
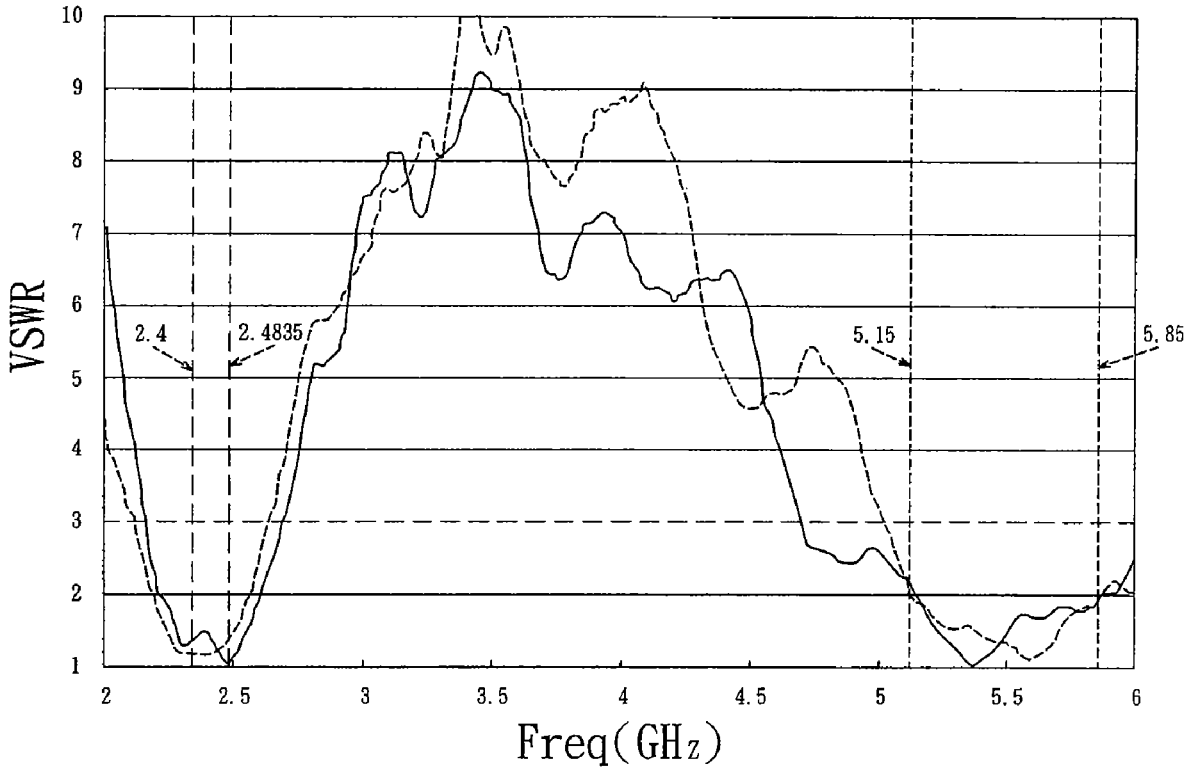
FIG. 16 is a plot illustrating a voltage standing wave ratio of the second preferred embodiment.
Figure 17:
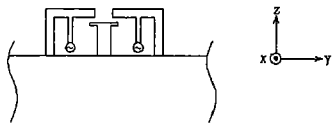
FIG. 17 is a plot illustrating radiation patterns of the left antenna and the parasitic coupler of the second preferred embodiment on the x-y, x-z, and y-z planes when operated at 2.437 GHz.
Figure 17:
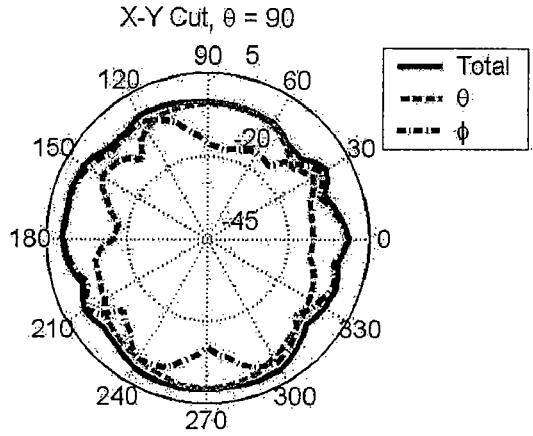
Figure 17:
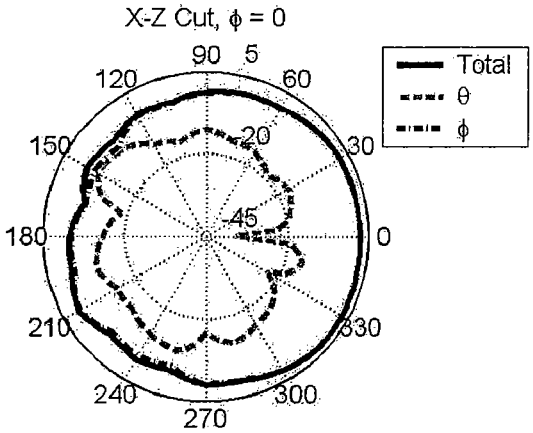
Figure 17:
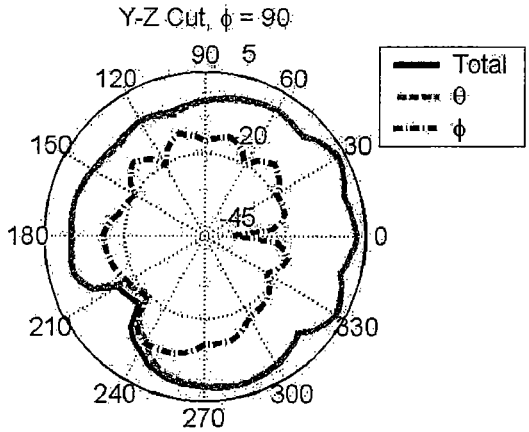
Figure 18:
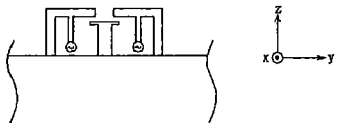
FIG. 18 is a plot illustrating radiation patterns of the left antenna and the parasitic coupler of the second preferred embodiment on the x-y, x-z, and y-z planes when operated at 5.470 GHz.
Figure 18:
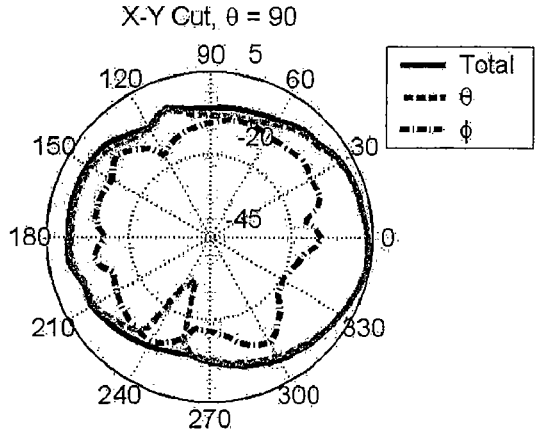
Figure 18:
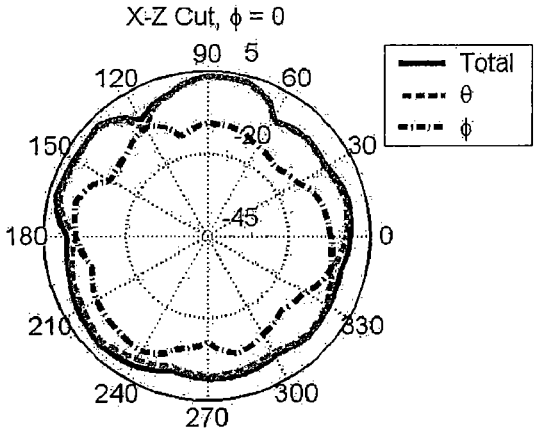
Figure 18:
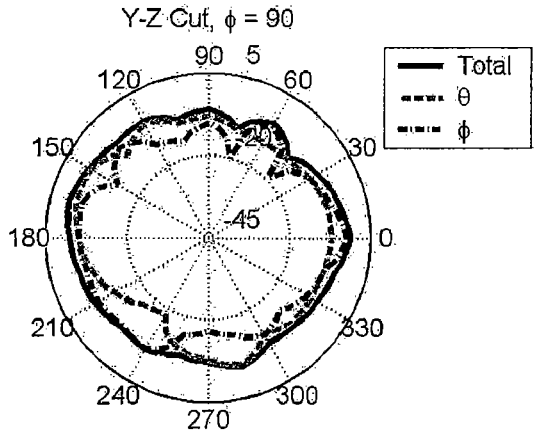
Figure 19:
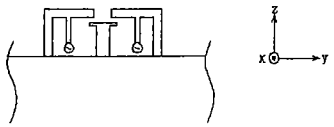
FIG. 19 is a plot illustrating radiation patterns of the right antenna and the parasitic coupler of the second preferred embodiment on the x-y, x-z, and y-z planes when operated at 2.437 GHz.
Figure 19:
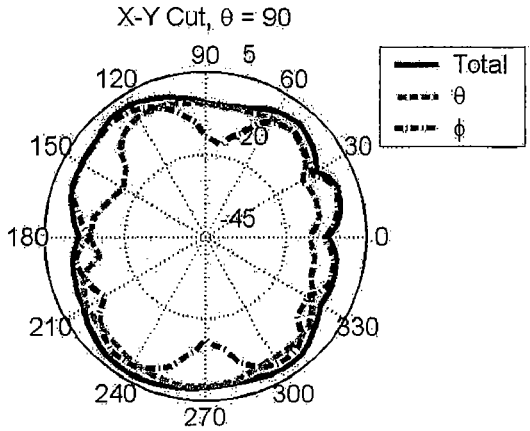
Figure 19:
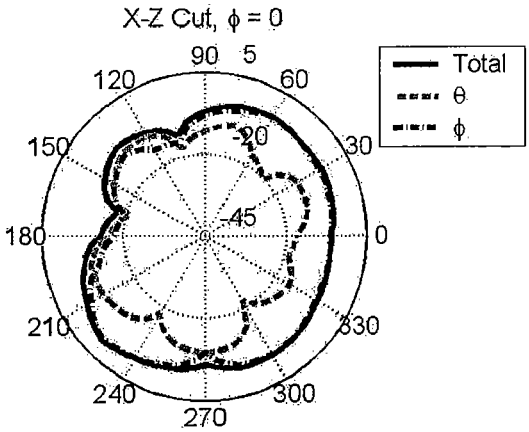
Figure 19:
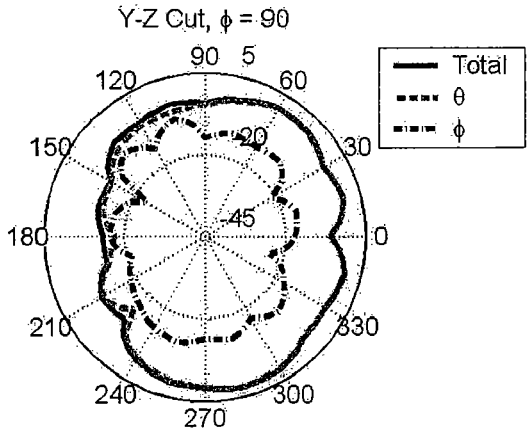
Figure 20:
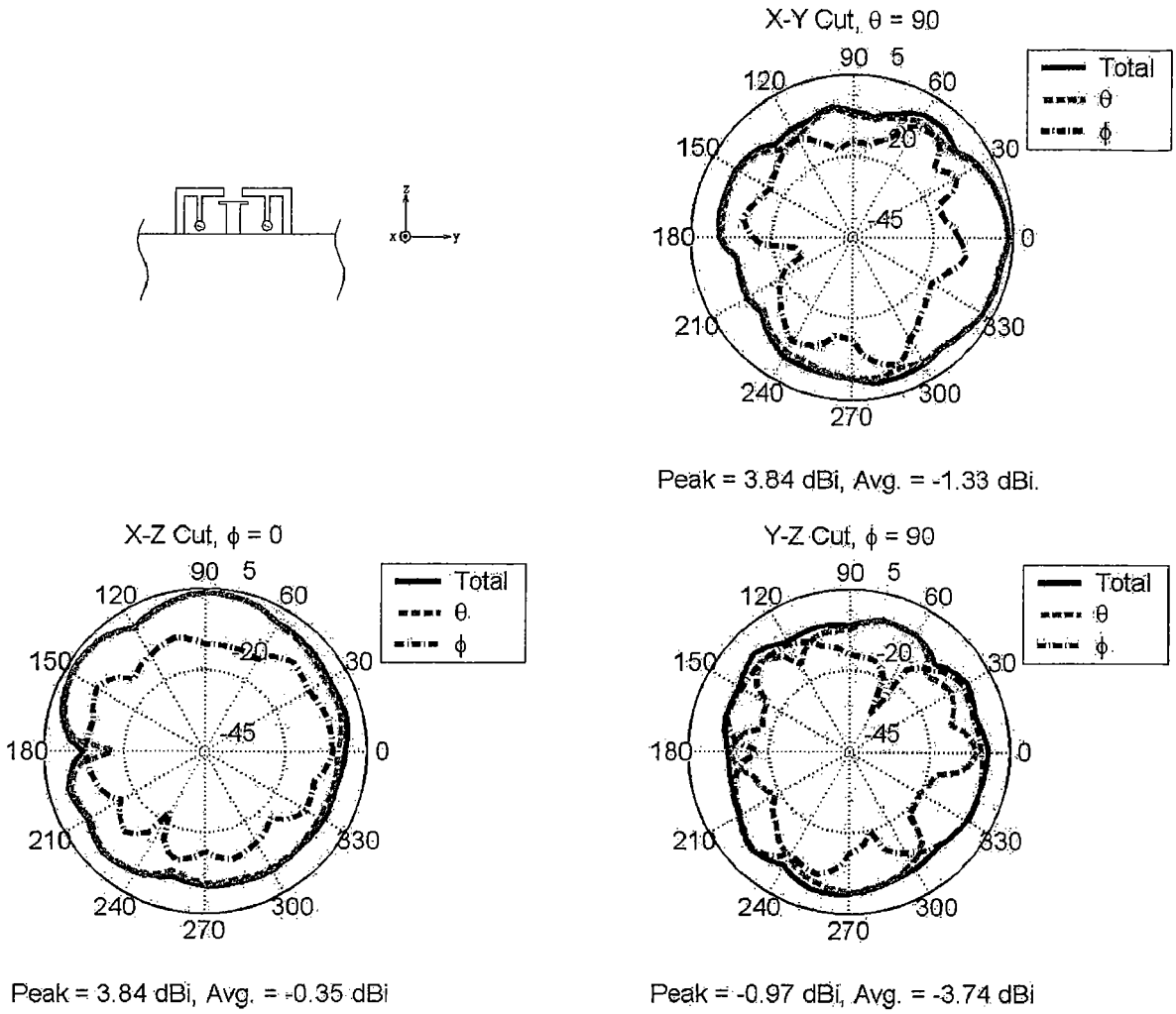
FIG. 20 is a plot illustrating radiation patterns of the right antenna and the parasitic coupler of the second preferred embodiment on the x-y, x-z, and y-z planes when operated at 5.470 GHz.

Based on experimental results, as illustrated in FIG. 16, the antenna unit 2 of this embodiment, when operated within 2.4 GHz and 2.4835 GHz and within 5.15 GHz and 5.85 GHz, achieves a voltage standing wave ratio (VSWR) of less than 2.0. In addition, as shown in Table I, the antenna unit 2 of this embodiment, when operated within 2.412 GHz and 2.462 GHz and within 5.150 GHz and 5.785 GHz, achieves satisfactory total radiation powers and radiation efficiencies. Moreover, as illustrated in FIGS. 17 and 18, each of the left antenna 22 and the parasitic coupler 23 of the antenna unit 2 of this embodiment has a substantially omnidirectional radiation pattern when operated within the 2.437 GHz bandwidth and within the 5.470 GHz bandwidth, respectively. Further, as illustrated in FIGS. 19 and 20, each of the right antenna 21 and the parasitic coupler 23 of the antenna unit 2 of this invention has a substantially omnidirectional radiation pattern when operated within the 2.437 GHz bandwidth and within the 5.470 GHz bandwidth, respectively. Hence, the antenna unit 2 of this embodiment is indeed suitable for WLAN and WWAN applications.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An antenna unit, comprising:

left and right antennas spaced apart from each other and operable within a first frequency bandwidth; and a parasitic coupler spaced apart from and disposed between said left and right antennas, and electromagnetically coupled to said left and right antennas so as to be operable within a second frequency bandwidth different from the first frequency bandwidth, wherein each of said left and right antennas includes:

a radiating element that has left and right ends, and an intermediate portion interconnecting said left and right ends thereof, one of said left and right ends being disposed distal from said parasitic coupler, the other of said left and right ends being disposed proximate to said parasitic coupler;

a grounding element that has upper and lower ends, said upper end of said grounding element being coupled to said one of said left and right ends; and a feeding element that has upper and lower ends, said upper end of said feeding element being coupled to said intermediate portion of said radiating element.

2. The antenna unit as claimed in claim 1, wherein said parasitic coupler includes a coupling element that has left and right ends, and an intermediate portion interconnecting said left and right ends thereof, and a grounding element that has upper and lower ends, said upper end of said grounding element of said parasitic coupler being coupled to said intermediate portion of said coupling element.

3. The antenna unit as claimed in claim 2, wherein said right end of said radiating element of said left antenna is disposed above said left end of said coupling element of said parasitic coupler, said right end of said radiating element of said left antenna and said left end of said coupling element of said parasitic coupler defining a vertical distance therebetween that ranges from 0.5 millimeters to 3.0 millimeters.

4. The antenna unit as claimed in claim 2, wherein said right end of said radiating element of said left antenna is disposed below said left end of said coupling element of said parasitic coupler, said right end of said radiating element of said left antenna and said left end of said coupling element of said parasitic coupler defining a vertical distance therebetween that ranges from 0.5 millimeters to 3.0 millimeters.

5. The antenna unit as claimed in claim 2, wherein said left end of said radiating element of said right antenna is disposed above said right end of said coupling element of said parasitic coupler, said left end of said radiating element of said right antenna and said right end of said coupling element of said parasitic coupler defining a vertical distance therebetween that ranges from 0.5 millimeter to 3.0 millimeters.

6. The antenna unit as claimed in claim 2, wherein said left end of said radiating element of said right antenna is disposed below said right end of said coupling element of said parasitic coupler, said left end of said radiating element of said right antenna and said right end of said coupling element of said parasitic coupler defining a vertical distance therebetween that ranges from 0.5 millimeters to 3.0 millimeters.

7. The antenna unit as claimed in claim 2, wherein said feeding element of said left antenna and said left end of said coupling element of said parasitic coupler define a horizontal distance therebetween that ranges from 0.5 millimeters to 3.0 millimeters.

8. The antenna unit as claimed in claim 2, wherein said feeding element of said right antenna and said right end of said coupling element of said parasitic coupler define a horizontal distance therebetween that ranges from 0.5 millimeters to 3.0 millimeters.

9. The antenna unit as claimed in claim 2, wherein said grounding element of each of said left and right antennas is formed with a hole therethrough.

10. The antenna unit as claimed in claim 2, further comprising a metallic strip that interconnects said lower ends of said grounding elements of said left and right antennas and said grounding element of said parasitic coupler.

11. The antenna unit as claimed in claim 1, wherein the first frequency bandwidth is lower than the second frequency bandwidth.

12. The antenna unit as claimed in claim 11, wherein the first frequency bandwidth is the 2.4 GHz bandwidth and the second frequency bandwidth is the 5 GHz bandwidth.

13. The antenna unit as claimed in claim 1, wherein the first frequency bandwidth is higher than the second frequency bandwidth.

14. The antenna unit as claimed in claim 13, wherein the first frequency bandwidth is the 5 GHz bandwidth and the second frequency bandwidth is the 2.4 GHz bandwidth.

* * * * *